US005801607A

United States Patent [19]

Duverger

[11] Patent Number: 5,801,607

[45] Date of Patent: Sep. 1, 1998

[54] STARTER CONTACTOR HAVING IMPROVED FIXED CONTACTS, AND A MOTOR VEHICLE STARTER HAVING SUCH A CONTACTOR

[75] Inventor: Jean Duverger, Riorges, France

[73] Assignee: Valeo Equipments Electriques Moteur, Creteil, France

[21] Appl. No.: 727,941

[22] Filed: Oct. 9, 1996

[30] Foreign Application Priority Data

Oct. 12, 1995 [FR] France ..... 95 12076

[51] Int. Cl.[6] ..... H01H 67/02

[52] U.S. Cl. ..... 335/126; 335/131

[58] Field of Search ..... 335/126, 131

[56] References Cited

U.S. PATENT DOCUMENTS

| | | | |
|---|---|---|---|
| 4,644,179 | 2/1987 | Pointout | 335/126 |
| 4,801,909 | 1/1989 | Fasola | 335/126 |

FOREIGN PATENT DOCUMENTS

| | | |
|---|---|---|
| 155 983 | 10/1985 | European Pat. Off. . |
| 532 250 | 8/1931 | Germany . |
| 3925152 | 2/1991 | Germany . |

OTHER PUBLICATIONS

French Search Report dated 21 Jul. 1996.

*Primary Examiner*—Lincoln Donovan
*Attorney, Agent, or Firm*—Morgan & Finnegan, LLP

[57] ABSTRACT

A starter contactor for a motor vehicle comprises a movable contact element of electrically conductive material, the displacements of which are controlled from a rest position to an active position in which it connects electrically the heads of two fixed power contact terminals, at least one of which is connected electrically to an auxiliary fixed contact element with which the movable contact element cooperates so as to connect the movable contact element with the associated fixed power contact terminal in a position intermediate between the rest and active positions.

10 Claims, 3 Drawing Sheets

X
X
10
12
14
16
18
20
22
24
26
28
30
32
34
36
38
40
42
42
44
46
48
50
52
52
54
54
56
56
58
58
60
60
62

STARTER CONTACTOR HAVING IMPROVED FIXED CONTACTS, AND A MOTOR VEHICLE STARTER HAVING SUCH A CONTACTOR

FIELD OF THE INVENTION

The present invention relates to contactors for motor vehicle starters.

BACKGROUND OF THE INVENTION

In one known design, a motor vehicle starter, and the like contactor comprises a movable contact element of electrically conductive material, the displacements of which are controlled from a rest position to an active position. In this active position, the movable contact member connects electrically together the heads of two fixed power contact terminals. The movable contact element is biassed elastically towards its rest position, and its displacements along its course of travel towards the active position, for the purpose of completing the motor circuit by connecting together the two main terminals of the contactor, are controlled by a movable core which is mounted for sliding movement within a set of windings of the contactor.

This movable contact element is for example made in the form of a contact plate which is disposed in a plane lying substantially at right angles to its direction of displacement. The front face of the movable contact plate, facing towards the heads of the fixed power contact terminals, connects these two heads electrically together at the instant when it reaches its active position. This contact between the moving plate and the heads of the power contact terminals thus takes the form of a sudden impact, without any sliding movement. This impact, closing the electrical circuit to the starter motor, generally tends to give rise to contact rebounds. Such a rebound at once breaks the freshly made contact with one of the two contacts each of which is defined by the head of one of the fixed power contact terminals and the movable contact plate. The result of this is that electric arcs occur, and these can cause the moving plate to become stuck or welded against the power contact head, due to melting of copper particles on their surfaces. When this welding effect takes place, it becomes impossible to stop the starter, which very rapidly leads to its destruction.

Reopening of the contacts due to impact, as described above, also tends to give rise to accelerated wear in the heads of the power contact terminals.

When the electrical power supply circuit to the starter motor is set up by the movable contact plate, the instantaneous establishment of the full starter motor supply voltage is detrimental to the useful life of the brushes of the motor.

Again, in the event of freezing of one of the components making contact with each other, giving rise to icing up, and in particular in the case of the heads of the power contact terminals, the starter cannot operate at all. It is only the impact force exerted on closure of the contacts that is available to break the layer of ice deposited on the components, so that the ice is shattered. It is however found that the value of these impact forces is not great enough, in most cases of icing up, to break the ice to an extent sufficient to enable proper electrical contact to be made.

DISCUSSION OF THE INVENTION

An object of the present invention is to propose a new design of a starter contactor of the type described above, which overcomes the above mentioned drawbacks.

According to the invention, a starter contactor for a motor vehicle, of the type comprising a movable contact element of an electrically conductive material, the displacements of which are controlled from a rest position to an active position in which it connects electrically together the heads of two fixed power contact terminals, is characterised in that at least one fixed power contact terminal is connected electrically to a fixed auxiliary contact member with which the movable contact element comes into cooperation, for electrical connection of the latter with the associated fixed power contact terminal, in a position intermediate between the rest and active positions.

According to a preferred feature of the invention, the fixed auxiliary contact member extends substantially parallel to the direction of displacement of the movable contact element, and the movable contact element cooperates with the fixed auxiliary contact member along its course of displacement between the intermediate position and active position.

The fixed auxiliary contact member then preferably has an inherent electrical resistance greater than zero, which determines a reduced value of the intensity of electric current flowing in the electrical circuit that connects the two fixed power contact terminals when the movable contact element is in cooperation with the fixed auxiliary contact member.

According to another preferred feature of the invention, the movable contact element is adapted to cooperate with the fixed auxiliary contact member through a lateral edge of the movable contact element, and with the head of the associated fixed power contact terminal through a transverse surface portion of the movable contact element which is disposed substantially at right angles to the direction of displacement of the latter, the transverse surface portion being bounded by the lateral edge.

The fixed auxiliary contact member preferably comprises a resiliently deformable conductive finger which is deformed by the movable contact element when the latter is in cooperation with the conductive finger, to guarantee good electrical contact between the fixed auxiliary contact member and the movable contact element.

In this latter case, in preferred embodiments of the invention the conductive finger is made integral with an annular eye portion of the fixed auxiliary contact element, with the body portion of the associated fixed power contact terminal passing through the eye portion, the eye portion being in axial abutment against the annular face which defines the junction between the head and the said body portion of the fixed power contact terminal.

According to a further preferred feature of the invention, each of the fixed power contact terminals is connected to an associated fixed auxiliary contact member.

According to yet another preferred feature of the invention, the heads of the two fixed power contact terminals are disposed in a common plane at right angles to the direction of displacement of the movable contact element, the latter being in the form of a contact plate lying in a plane substantially at right angles to the direction of its displacement.

In some embodiments of the invention, the two fixed auxiliary contact elements extend over the same length.

The invention also provides a starter for an internal combustion engine for a motor vehicle, characterised in that the starter is equipped with a contactor in accordance with the invention.

Further features and advantages of the invention will appear more clearly on a reading of the following detailed description of a preferred embodiment of the invention, which is given by way of non-limiting example only and with reference to the accompanying drawings.

DESCRIPTION OF A PREFERRED EMBODIMENT OF THE INVENTION

Figures 1, 2:
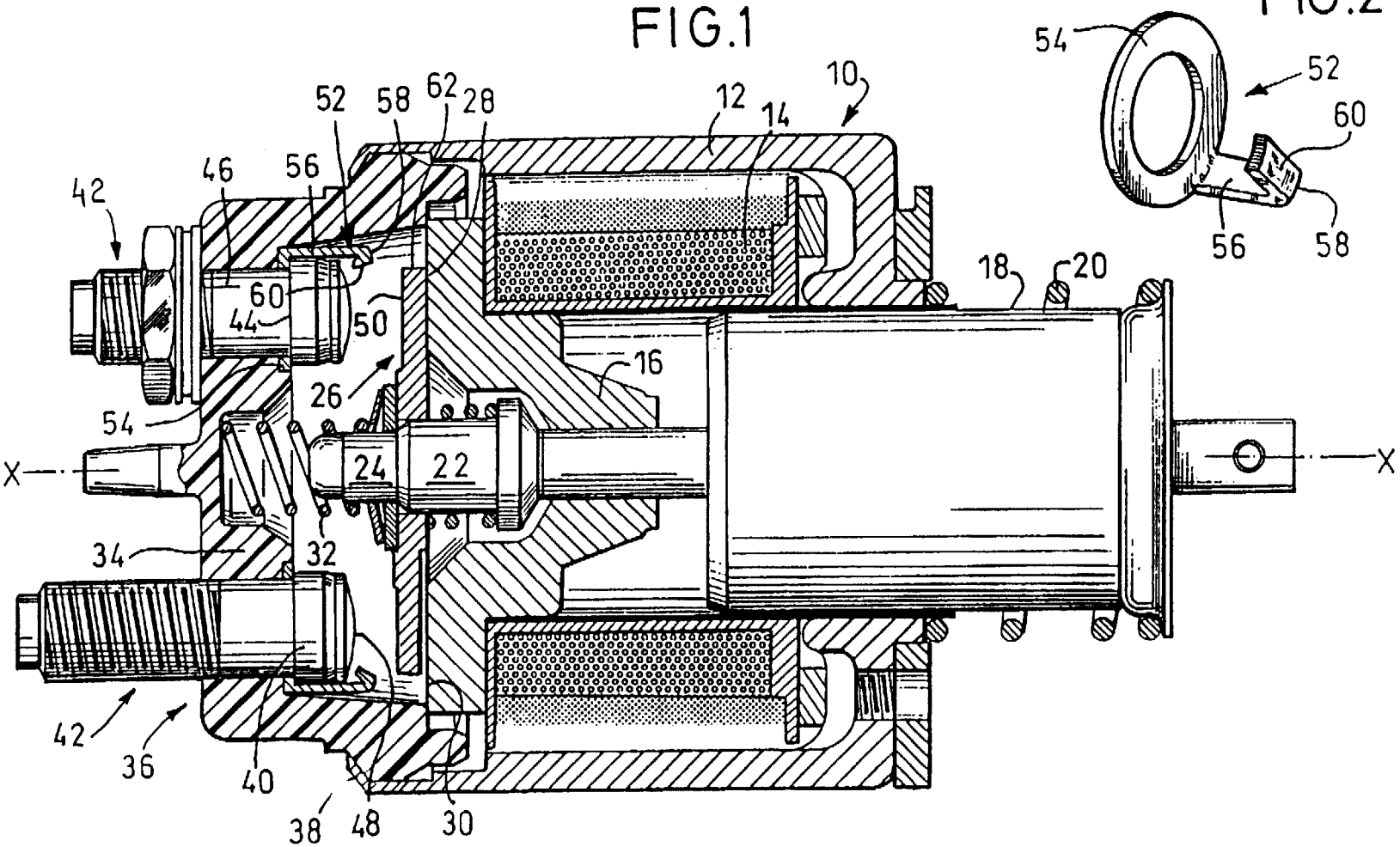
FIG. 1 is a view, in partial axial cross section, of a starter contactor made in accordance with the present invention.
FIG. 2 is a perspective view of an auxiliary contact member in the contactor of FIG. 1.

FIG. 1 shows a contactor 10 with which a starter (not shown), for an internal combustion engine of a motor vehicle, is equipped. The contactor 10 consists essentially of a carcase or body shell 12 of magnetic material, in which a fixed assembly is received, this fixed assembly consisting of windings 14 together with a fixed polar core 16.

The electric power supply to the windings 14 is such that, when the windings 14 are energised, they cause a movable core 18 to be displaced from right to left (with reference to FIG. 1). The core 18 is biassed elastically by means of a return spring 20, towards its rest position which is shown in FIG. 1. The movable core 18 is arranged for sliding movement in the body shell 12, and carries a control rod 22 which is itself mounted for sliding movement within the fixed polar core 16. The control rod 22 has a free end portion 24 which lies in front of the fixed polar core 16.

A movable contact element 26 is carried by the free end portion 24 of the control rod. The movable contact element 26 is in the form of a movable contact plate of generally rectangular form, having a rear face 28 which is biassed elastically towards its rest position (again as shown in FIG. 1), in which it is in axial abutment against the front face 30 of the fixed polar core 16. The movable contact plate 26 is biassed towards its rest position by means of a second return spring 32, which is interposed between the front end portion 24 of the control rod 22 and the transverse base portion 34 of a closure cap 36 of the contactor. This closure cap 36 is seamed on to the front end 38 of the body shell 12.

The movable contact plate 26 is arranged, in a known manner, and under the action of the movable core 18, to connect electrically together the contact heads 40 of two fixed power contact terminals 42. These terminals 42 are fixed in the transverse base portion 34 of the closure cap 36. The contact heads 40 are situated in the hollow interior of the cup-shaped closure cap 36, and they bear against the internal face of the transverse base portion 34 of the latter, each through its annular face 44 which defines a junction between the head 40 and the body portion 46 of the corresponding contact terminal 42. Each of these body portions 46 extends through the transverse base portion 34 of the closure cap, and is adapted for connection of the terminal 42 to the power supply circuit of the starter motor, in a manner to be explained below with reference to FIGS. 3 to 6.

The rear or contact faces 48, i.e. the contact faces, of the two contact heads 40 lie in substantially the same plane, which is at right angles to the axis X—X of the contactor, that is to say at right angles to the direction in which the movable contact plate 26 is displaced. The movable contact plate 26 is arranged to connect the two terminals 42 electrically together when its front face 50 makes contact with the contact faces 48 of the heads 40 of the terminals 42. The terminals 42, and the movable contact plate 26, are of course made of electrically conductive material, and the closure cap 36 in which the terminals 42 are fitted is of a suitable insulating material.

Each of the heads 40 of the contact terminals 42 is associated with a fixed auxiliary contact member 52 which is shown in detail in FIG. 2, to which reference is now made. Each of these auxiliary contact members 52 consists of a component which is formed by stamping and bending from electrically conductive sheet material, and includes an annular eye portion 54 which is interposed between the annular face 44 of the associated contact terminal 42 and the internal face of the base 34 of the closure cap 36. The base portion 34 is formed with a groove of complementary form to the associated eye portion 54, for location of the latter in it.

Each auxiliary contact member 52 also includes a conductive finger 56 in the form of a flat strip, which is joined to the eye portion 54 and which extends longitudinally, that is to say in a direction parallel to the axis X—X of the contactor, along the contact head 40 and beyond the contact face 48 of the latter. Each finger 56 is deformable elastically, and has at its free rear end 58 a portion 60 which is bent back substantially at 180 degrees. This portion 60 constitutes a ramp for cooperation with the corresponding axial or lateral edge 62 of the movable contact plate 26. The ramp portion 60 therefore lies in facing relationship with the lateral edge 62.

In operation, the movable contact plate 26 is displaced from its rest position shown in FIG. 1 towards its active position, in which its front face 50 comes into contact with the contact faces 48 of the heads 40 of the contact terminals 42. During this movement, the plate 26 first comes into cooperation, through its lateral edge 62, with the auxiliary contact members 52, in an intermediate position between the rest and active positions. The plate 26 thus makes contact with the members 52 before any contact is established through its front face 50.

Each eye portion 54 may include suitable means (not shown) for providing angular indexation of the contact member 52 with respect to the cover plate 36, thus ensuring that it will occupy its fitted orientation shown in FIG. 1, in which the ramp portion 60 of the contact member lies in facing relationship with the lateral edge 62 of the movable contact plate 26.

Figure 3:
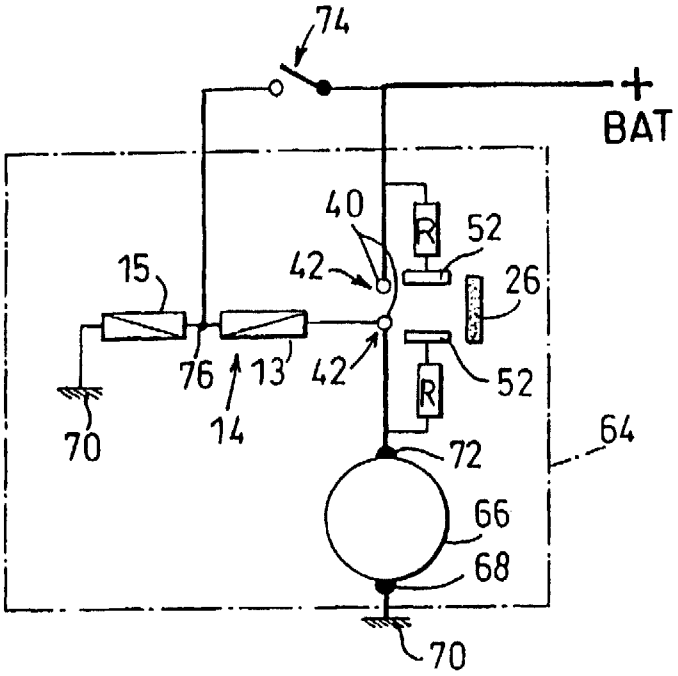
FIG. 3 is an electrical circuit diagram which illustrates the establishment of the electrical connection which completes the power circuit of a starter equipped with a contactor in accordance with the invention, the contactor being shown in the rest position of the movable contact element, in which position the contactor is in an open-circuit condition.

Reference is now made to the circuit diagram in FIG. 3, which shows a starter 64 comprising an electric motor 66, one terminal 68 of which is connected to the electrical ground 70. The other terminal 72 of the electric motor 66 is connected to one of the fixed power contact terminals 42 of the contactor. The other fixed power contact terminal 42 of the contactor is connected to the positive pole +BAT of the battery of the vehicle.

FIG. 3 also shows the switch 74 for the power supply to all of the windings 14 of the contactor 10. The switch 74 connects the positive pole +BAT to a mid-point 76 of the set of windings 14. One of these windings, 15, is a bias winding connected to ground 70, while the other winding, 13, is connected to the same fixed power terminal 42 to which the motor terminal 72 is connected. FIG. 3 also shows the two auxiliary contact members 52 and the movable contact 26.

Each fixed auxiliary contact member 52 has a predetermined inherent electrical resistance greater than zero, which is represented in FIGS. 3 to 6 as a resistance R.

When the driver of the vehicle causes the starter switch 74 to be closed, the windings 14 are supplied with power. This causes the movable core 18 to be displaced away from its rest position (FIGS. 1 and 3), so as at the same time to displace the movable contact plate 26, so that the latter also leaves its rest position. During this displacement, the movable contact plate 26 comes into the above mentioned intermediate position. In this position, which is shown in FIG. 4, the plate 26 enters into contact with both of the fixed auxiliary contact members 52.

The electric starter motor 66 is now supplied with power from the battery of the vehicle through the two resistances R of the fixed auxiliary contact members 52, which are in series in the electrical circuit that connects the positive pole +BAT of the battery to the starter motor 66. The voltage at the terminals 68 and 72 of the motor 66 is thus reduced, and it is therefore a reduced intensity of current 11 that flows in its power supply circuit which includes the two resistances R in series. The value of the resistance R is high enough to prevent any rotation of the armature of the starter motor.

Figure 4:
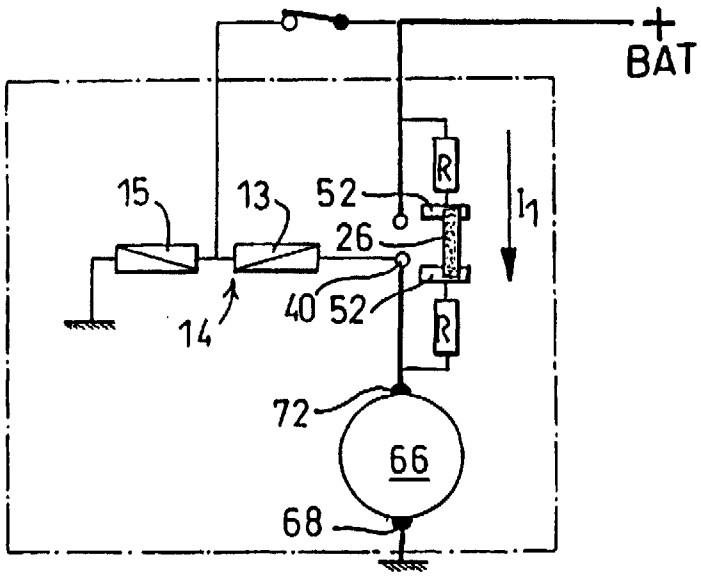
FIG. 4 is a view similar to that in FIG. 3, in which the movable contact element is shown in an intermediate position.
Figure 5:
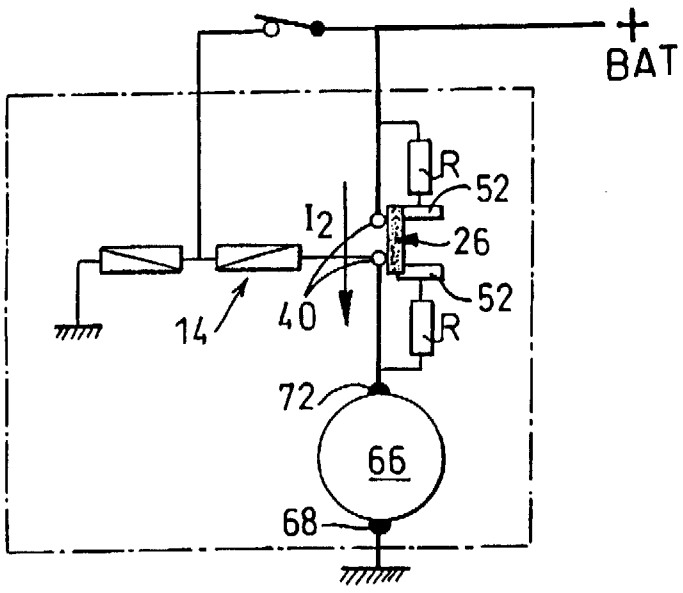
FIG. 5 is a view similar to FIGS. 3 and 4, but shows the movable contact element in its active position.

Under the action of the movable core 18, the course of travel of the movable contact 26 continues from its intermediate position shown in FIG. 4 until it reaches the active position shown in FIG. 5. In FIG. 5 it can be seen that, in the active position, the movable contact 26 enables power to be supplied to the starter motor 66 from the positive pole +BAT of the battery to the terminal 72 of the motor, directly through the movable contact plate 26 and the heads 40 of the fixed terminals 42 of the contactor, since the plate 26 is now in direct contact with the heads 40.

The intensity of the current $I_2$ flowing through the power supply circuit of the motor 66 is therefore now at its maximum value. This value is still, however, smaller than the value of current which would have been taken by the starter motor if there had not been a preliminary phase of rotation of the motor at reduced speed. This preliminary phase, starting when the system is in the intermediate position shown in FIG. 4, is the phase in which current is supplied to the motor through the auxiliary contact members 52 but not yet through the face 50 and contact faces 48. The current is reduced, due to the existence of a counter-electromotive force during this preliminary phase. In this way, sharp points of high current are avoided, thus reducing premature wear effects in the brushes of the starter motor 66.

Figure 6:
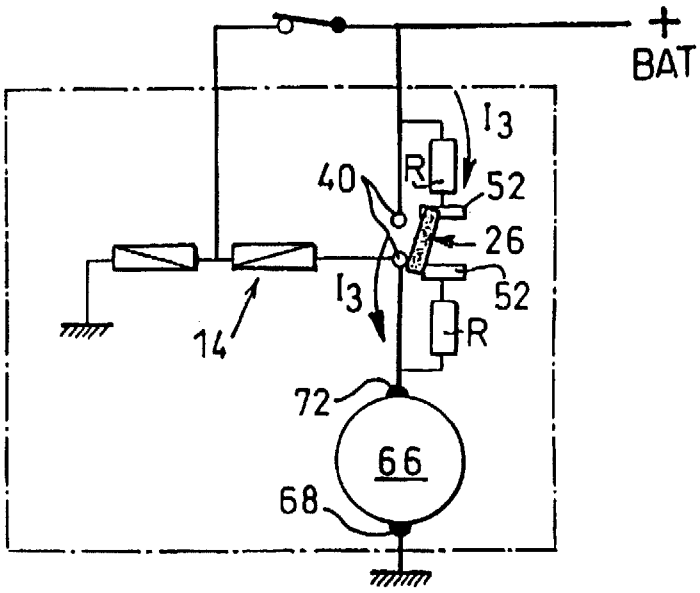
FIG. 6 is a view similar to FIGS. 3 to 5, but shows the movable contact element in an abnormal position corresponding to a fault in the establishment of the contacts.

Reference is now made to FIG. 6, showing an abnormal or incorrect mode of operation of the contactor. This incorrect operation may have two causes. The first of these arises for example under freezing conditions.

Under these circumstances, the power contact terminal head 40 which is connected to the positive terminal +BAT of the battery can be insulated by a layer of ice which prevents the movable contact plate 26 making proper contact with the terminal head 40 at the end of the course of displacement of the former. The current $I_3$ which is then supplied to the starter motor 66 is smaller than the normal current $I_2$ of maximum intensity, due to the fact that one of the resistances R is still connected in series in the power supply circuit, directly to the terminal 72 of the starter motor 66.

This causes heating, by Joule effect, of the associated fixed auxiliary contact member 52. The associated terminal 42, with its contact head 40, is therefore heated by conduction, and this melts the ice covering it. After a time delay, this enables normal contact to be reestablished between the moving contact plate 26 and both of the heads 40, in the manner shown in FIG. 5.

In the event that both of the contact heads 40 are iced up, the automatic deicing just described, by heating of the fixed auxiliary contact members 52, takes place in exactly the same way, but in this case each of the auxiliary contact members 52 has the current $I_1$ (FIG. 4) of reduced intensity passing through it.

Another cause of incorrect operation of the contactor, again as represented in FIG. 6, can be contact rebound. In this connection, due to the design of the fixed auxiliary contact members 52, rebounds caused by mechanical oscillation are much less likely to occur than in the case where traditional contacts are used which consist only of the heads 40 of the fixed terminals 42.

Thus, during the phase in which the movable contact 26 is approaching the power contact heads 40, the movable contact is decelerated due to friction between the ramp portions 60 of the contact members 52 and the lateral edge 62 of the contact plate 26. In addition, vibration energy is partly absorbed by friction along the auxiliary contact members 52. However, in the event that contact is broken due to the occurrence of a rebound, the movable contact 26 then occupies the position shown in either FIG. 6 or FIG. 3, though the power supply current for the starter motor 66 is not interrupted.

There is therefore no electric arc, and the power supply current is only reduced during the period of oscillation of the movable contact 26.

The design of contactor described above by way of example, and indeed that of any contactor in accordance with the invention, thus enables the starter to become operational very quickly in the event of freezing of the contacts, and it enables an initial power supply to be delivered to the starter motor at a reduced voltage, while eliminating the detrimental effects of contact rebounds.

What is claimed is:

1. A motor vehicle starter contactor comprising: a body; a pair of power contact terminals fixed in the body and each having a contact head; an electrically conductive movable contact element having rest, intermediate and active positions; and means in the body for mounting said movable contact element for displacement in a longitudinal direction in said body between said rest position, in which the movable contact element is out of contact with said fixed power contact terminals, and said active position in which said movable contact element engages said fixed power contact terminals whereby to connect said fixed power contact terminals electrically together, the contactor further having a fixed auxiliary contact member connected electrically to at least a respective one of said fixed power contact terminals, with said auxiliary contact member extending beyond an associated one of said fixed power contact terminals to selectively engage said movable contact element in said intermediate position of said movable contact element between said rest and active positions, whereby the movable contact element is selectively connected electrically with said associated fixed power contact terminal through said auxiliary contact member when in said intermediate position.

2. A contactor according to claim 1, in which the means mounting the movable contact element defines a direction of displacement of the latter in said body, said fixed auxiliary contact member extending substantially parallel to said direction of longitudinal displacement, said fixed auxiliary contact member being disposed to enable said movable contact element to cooperate with said fixed auxiliary contact member throughout said displacement of said movable contact element between said intermediate and active positions.

3. A contactor according to claim 2, wherein said fixed auxiliary contact member has an electrical resistance greater than zero, whereby, when said movable contact element engages said fixed auxiliary contact member, said resistance of said fixed auxiliary contact member establishing a reduced value of the current flowing through said fixed power contact terminals.

4. A contactor according to claim 2, wherein said movable contact element has a lateral edge, said fixed auxiliary contact member engaging said lateral edge, said movable contact element further having a transverse surface portion bounded by said lateral edge and disposed substantially at right angles to said longitudinal displacement direction of said movable contact element, said movable contact element transverse surface portion engaging said head of said fixed power contact terminal associated with said fixed auxiliary contact member.

5. A contactor according to claim 3, wherein said fixed auxiliary contact member comprises a resiliently deformable conductive strip element for engaging said movable contact element, said strip element being selectively deformed by the movable contact element to establish electrical contact between said movable contact element and said fixed auxiliary contact member.

6. A contactor according to claim 5, wherein each said fixed power contact terminal further includes a body portion defining a junction between said body portion and said head of said fixed power contact terminal, said junction defining an annular junction face, said fixed auxiliary contact member further having an annular eye portion integral with said strip element, said body portion of said associated fixed contact terminal extending through said eye portion, said eye portion being in axial abutment against said annular junction face.

7. A contactor according to claim 1, having a second fixed auxiliary contact element, each of said fixed auxiliary contact elements being connected with a respective one of said fixed power contact terminals.

8. A contactor according to claim 1, wherein said means in the body mounting the movable contact element define said direction of longitudinal displacement of the movable contact element in said body, said head for each of said two fixed power contact terminals defining a common plane at right angles to said direction of longitudinal displacement, said movable contact element having a plate element lying in a plane substantially at right angles to said longitudinal direction of displacement.

9. A contactor according to claim 7, in which said means mounting said movable contact element defines said longitudinal direction of displacement of said movable contact element in said body, said fixed auxiliary contact member extending substantially parallel to said longitudinal direction of displacement, said fixed auxiliary contact member enabling said movable contact element to engage said fixed auxiliary contact element throughout said movable contact element longitudinal displacement between said intermediate and active positions.

10. A motor vehicle starter having a contactor according to claim 1.

* * * * *